United States Patent [19]

Franssen, deceased et al.

[11] 4,361,727

[45] Nov. 30, 1982

[54] SOUND REPRODUCING ARRANGEMENT FOR ARTIFICIAL REVERBERATION

[75] Inventors: Nico V. Franssen, deceased, late of Knegsel, Netherlands; by Friedrich J. de Haan, administrator, Dommelen, Netherlands

[73] Assignee: U.S. Philips Corporation, New York, N.Y.

[21] Appl. No.: 120,413

[22] Filed: Feb. 11, 1980

[30] Foreign Application Priority Data

Feb. 13, 1979 [NL] Netherlands ..... 7901120

[51] Int. Cl.[3] ..... G10K 11/00

[52] U.S. Cl. ..... 179/1 J

[58] Field of Search ..... 179/1 AT, 1 B, 1 DM, 179/1 FS, 1 J; 84/DIG. 26

[56] References Cited

U.S. PATENT DOCUMENTS 3,392,240 7/1968 Parkin ..... 179/1 J

FOREIGN PATENT DOCUMENTS 758877 6/1954 Fed. Rep. of Germany .

1259512 1/1972 United Kingdom .

OTHER PUBLICATIONS

N. V. Franssen, "Sur l'Amplification des Champs Acoustiques", pp. 315-323 of Acustica, vol. 20, 1968.

*Primary Examiner*—Joseph A. Popek

*Attorney, Agent, or Firm*—Robert T. Mayer; Bernard Franzblau

[57] ABSTRACT

An artificial reverberation arrangement comprising a number of mechanical units each of which comprises a microphone, an amplifier and a loudspeaker. These units are arranged in such a way relative to each other that the microphone of one specific unit receives substantially less sound energy from its own associated loudspeaker than from all the other loudspeakers of the arrangement.

6 Claims, 2 Drawing Figures

SOUND REPRODUCING ARRANGEMENT FOR ARTIFICIAL REVERBERATION

BACKGROUND OF THE INVENTION

The invention relates to a sound reproducing arrangement for artificial reverberation in which a plurality of loudspeakers are arranged within an enclosed space. The loudspeakers are connected to associated microphones via amplifiers, and the loop gain of each of the systems constituted by an associated microphone, amplifier and loudspeaker is small relative to one.

Such an arrangement is inter alia, described in British Pat. No. 1,259,512. Its operation is based on the following: It is assumed that in said space an audio source is present which is independent of said arrangement, for example one or more speakers, an orchestra or the like. A microphone, which is suspended at a specific location in said space, picks up the sound at said location and, after amplification, produces a corresponding sound signal in the associated loudspeaker. The system: microphone, amplifier, and loudspeaker thus functions as a sound-reinforcing reflector of the sound at the location of the microphone, which makes the impression on the audience as through a number of sound reinforcing walls were placed in said space. As the sound always requires a certain time delay to reach the microphone from the sound source and subsequently to reach the audience from the loudspeaker, this corresponds to a specific reverberation time and the entire system may therefore be referred to as an "artificial reverberation system". However, in order to obtain a satisfactory effect a large number, for example 50 to 100, of such systems are necessary.

It is an object of the invention to improve the known arrangement. Until now it was believed that in order to avoid acoustic instabilities the microphone had to be placed at a substantial distance, for example at least a few meters, from the loudspeaker associated with the same system so that, as a result of this distance between microphone and loudspeaker, the loop gain in the system would remain small relative to one. However, in view of the large number of systems required, this leads to an extremely intricate cabling of the entire arrangement. Moreover, this may give rise to the effect that at some locations the sound from some of the loudspeakers is received sooner than that from the independent sound source, which adversely affects a natural reproduction.

SUMMARY OF THE INVENTION

The invention is characterized in that said systems take the form of separate mechanical units which are arranged in such a way relative to each other that the sound energy picked up by the microphone of the one system from its own loudspeaker is low relative to the sound energy which is picked up by said microphone from the loudspeakers which do not belong to its system. In other words, the mechanical units are located relative to each other so that the sound energy which a loudspeaker of one mechanical unit radiates is mainly determined by the sound energy picked up in total by the microphone of said one mechanical unit that is radiated from loudspeakers of units that are not a part of said one mechanical unit.

The invention is based on the recognition that by combining the microphone-amplifier-loudspeaker system into a single mechanical unit the acoustic feedback from the loudspeaker to the microphone can be precisely kept under control, e.g. by using a microphone with a cardioidal directivity pattern whose sensitivity minimum is directed toward the associated loudspeaker, said direct feedback can be reduced to substantially zero. Furthermore, by means of the aforementioned arrangement of the systems relative to each other such a strong sound signal is obtained at the location of the microphone that the amplifier included in the system may be operated at such a low setting that the acoustic stability of the arrangement is ensured.

In this respect it is to be noted that it is known per se, for example from German Gebrauchsmuster No. 1,753,247 to combine a microphone, amplifier and loudspeaker in one mechanical unit. This publication shows a mechanical unit composed of a microphone, an amplifier and a loudspeaker in the form of a so-called megaphone. Also in this case it is essential that the microphone picks up a minimal signal from its own loudspeaker so as to avoid acoustic instabilities. However, the deliberate interception of sound from other loudspeakers in said arrangement, in order to create an artificial reverberation effect, does not play a role in the megaphone disclosed therein.

BRIEF DESCRIPTION OF THE DRAWINGS

The invention will be described in more detail with reference to the accompanying drawing in which.

DESCRIPTION OF THE PREFERRED EMBODIMENT

Figure 1:
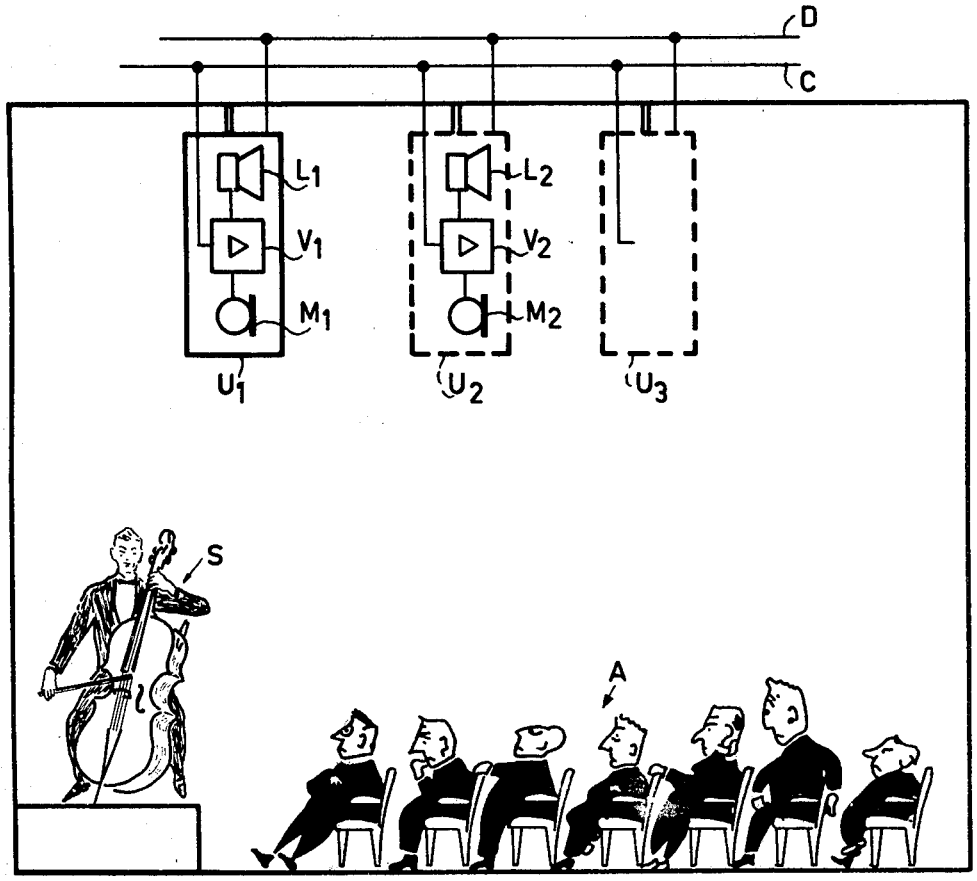
FIG. 1 represents an embodiment of the sound reproducing arrangement for artificial reverberation and FIG. 2 shows another mechanical unit for use in the sound reproducing arrangement of FIG. 1.

FIG. 1 of the drawing represents an enclosed space, inside which an audience A can listen to a programme. The space may for example be a hall. However it need not be enclosed, but may also be, for example, an open-air theatre. The programme may, for example, be the reproduction of music, but also of speech. Summarizing, there is provided at least one sound source S within the enclosed space, to which the audience A can listen. In order to realize, as it were, a plurality of sound-reinforcing reflectors between the source S and the auditorium, there are provided a large number of systems each comprising a microphone M, an amplifier V and a loudspeaker L, which in accordance with the invention take the form of separate mechanical units that are symbolically represented by the rectangles U. These mechanical units are arranged relative to each other in such a way that the sound energy which the microphone (for example $M_1$) of the one system ($U_1$) picks up from its own loudspeaker ($L_1$) is low relative to the sound energy which the aforesaid microphone ($M_1$) receives from all of the other loudspeakers ($L_2$ ...) together. Thus, the sound energy which a loudspeaker, for example $L_1$, of a mechanical unit or system $U_1$ radiates is mainly determined by the sound energy picked up in total by the microphone $M_1$ of the unit U1 and which is radiated from the loudspeakers $L_2$ etc. of the units $U_2$, $U_3$ etc. which do not belong to the unit $U_1$.

Specifically, two steps have been taken for this purpose. First of all loudspeakers with sufficiently wide, preferably spherical, directivity patterns are selected. Secondly, a microphone with a cardioidal directivity pattern is used, in which the direction of minimum sensitivity coincides with the direction in which the loudspeaker (L) is disposed relative to the microphone (M).

Figure 2:
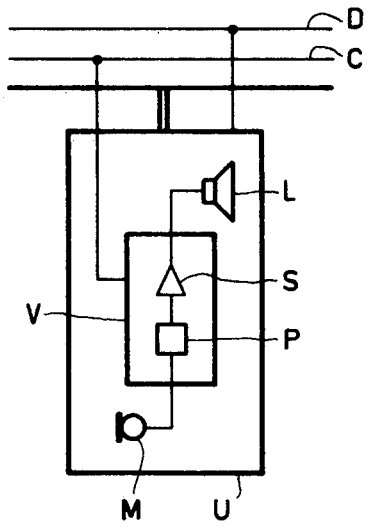

The amplifiers V are semiconductor amplifiers whose gain (and as the case may be, also the audio-frequency response), may be adjusted from a central location by means of a conductor C. Preferably, a control system is selected in which a control signal is passed via the conductor C, which signal controls an electronic gain control provided in the amplifier. In that case long conductors carrying an audio signal are not required at all. For the control range of the electronic gain control a range of 10 dB amply suffices in order to comply with realistic requirements in respect of reverberation time prolongation in halls of doubled size. In order to use amplifiers of limited power it is desirable to include an instantaneously acting peak voltage limiter in each amplifier, which are described in the literature in any conceivable version. FIG. 2 shows such a mechanical unit U including an amplifier V that includes a peak voltage limiter P. U.S. Pat. No. 4,000,370 describes one suitable peak voltage limiter. The peak voltage limiter is preferably connected between the microphone M and the input to the amplifier section S of the amplifier V. The output of the amplifier section is connected to the associated loudspeaker L. Power may be supplied to the amplifiers in the mechanical units may be effected via the conductor D in the form of an alternating current or of a direct current to be decoupled in the amplifier, in which case it is advisable to avoid interaction of the amplifiers via the power supply conductor D by a suitable decoupling means.

What is claimed is:

1. A sound-reproducing arrangement for artificial reverberation comprising, a plurality of loudspeakers arranged within an enclosed space, a plurality of microphones and a plurality of amplifiers, means connecting the loudspeakers to associated microphones via the amplifiers to form a plurality of separate mechanical units each of which includes a microphone, an amplifier and a loudspeaker connected in cascade, the loop gain of each of the mechanical units having a value less than one, and wherein the separate mechanical units are arranged in such a way relative to each other that the sound energy which the microphone of one mechanical unit picks up from its own loudspeaker is low relative to the sound energy which is picked up in total by said microphone from the loudspeakers not belonging to said one mechanical unit.

2. An arrangement as claimed in claim 1 wherein the microphone of at least one mechanical unit exhibits a cardioidal directivity pattern having a sensitivity minimum directed toward the loudspeaker of said one mechanical unit.

3. A sound-reproducing arrangement for artificial reverberation comprising, a plurality of separate mechanical units, each of said mechanical units including a microphone, an amplifier and a loudspeaker coupled together in cascade and with a loop gain having a value less than one, said loudspeakers being arranged within a given space, and wherein said mechanical units are located relative to each other such that the level of sound energy which a loudspeaker of a given mechanical unit radiates is mainly determined by the total of the sound energy picked up by the microphone of said given mechanical unit and which is radiated from loudspeakers of mechanical units other than said given mechanical unit.

4. An arrangement as claimed in claim 3 wherein the microphones exhibit a cardioid directivity pattern having a direction of minimum sensitivity oriented towards the loudspeaker of its own corresponding mechanical unit.

5. An arrangement as claimed in claims 3 or 4 wherein the amplifier in a mechanical unit comprises a remote gain control.

6. An arrangement as claimed in claims 3 or 4 wherein the amplifier in a mechanical unit includes a peak voltage limiter.

* * * * *